United States Patent [19]

Sloan et al.

[11] 4,267,002

[45] May 12, 1981

[54] MELT BLOWING PROCESS

[75] Inventors: Cephas H. Sloan; Jerry A. Wright; Gerald P. Morie, all of Kingsport, Tenn.

[73] Assignee: Eastman Kodak Company, Rochester, N.Y.

[21] Appl. No.: 17,744

[22] Filed: Mar. 5, 1979

[51] Int. Cl.[3] ..... B22B 31/00

[52] U.S. Cl. ..... 156/276; 156/167; 156/201; 156/441; 264/518; 264/DIG. 75; 428/375

[58] Field of Search ..... 156/180, 167, 201, 176, 156/276; 264/176 F, 518, DIG. 75; 428/375

[56] References Cited

U.S. PATENT DOCUMENTS

| | | | |
|---|---|---|---|
| 3,023,075 | 2/1962 | Lavman et al. | 264/168 |
| 3,032,456 | 5/1962 | Wade | 264/DIG. 75 |
| 3,110,642 | 11/1963 | Harrington et al. | 264/176 F |
| 3,148,101 | 9/1964 | Allman et al. | 156/167 |
| 3,250,602 | 5/1966 | Stalego | 156/167 |
| 3,313,665 | 4/1967 | Berger | 156/180 |
| 3,423,266 | 1/1969 | Davies et al. | 264/171 |
| 3,595,245 | 7/1971 | Buntin et al. | 156/180 |
| 3,600,483 | 8/1971 | Davis et al. | 264/205 |
| 3,615,998 | 10/1971 | Kolb et al. | 156/167 |
| 3,738,884 | 6/1973 | Soehngen | 156/167 |
| 3,755,527 | 8/1973 | Keller et al. | 264/152 |
| 3,796,619 | 3/1974 | Roch | 264/205 |
| 3,959,421 | 5/1976 | Weber et al. | 264/12 |
| 4,042,740 | 8/1977 | Krueger | 264/DIG. 75 |
| 4,100,324 | 7/1978 | Anderson et al. | 156/167 |

FOREIGN PATENT DOCUMENTS

| | | | |
|---|---|---|---|
| 1466627 | 12/1966 | France | 264/168 |
| 2138296 | 5/1973 | France | 264/DIG. 75 |
| 1330463 | 9/1973 | United Kingdom | 428/373 |

*Primary Examiner*—Jay H. Woo

*Attorney, Agent, or Firm*—John F. Stevens; Daniel B. Reece, III

[57] ABSTRACT

Thermoplastic materials are converted directly into thermally bonded, coherent fibrous products by melt blowing techniques. The fibrous product is in the form of a rod having a relatively dense, rigid skin in which the fiber portions are oriented primarily in a longitudinal direction with respect to the axis of the product, and a less dense core where the fiber portions are oriented primarily in a transverse direction with respect to the axis of the product. The products are made by melt blowing fibers and intercepting them by a fiber collecting and forming device which permits a relatively heavy build-up of fiber mass in the central portion and a relatively light build-up of fibers in a lip portion surrounding the central portion. As fibers are continuously deposited on the collecting and forming device, the product thus formed is withdrawn at a rate synchronized with collection of fibers such that the aforesaid build-up is maintained, and such that the lip portion is folded back over the central portion by the collecting and forming device to form the rod as described.

11 Claims, 7 Drawing Figures

MELT BLOWING PROCESS

BACKGROUND OF THE INVENTION

1. Field of the Invention

This invention relates to a process for producing a fibrous product by melt blowing thermoplastic material, and to the fibrous product produced thereby.

2. Description of the Prior Art

Various processes for producing melt-blown products from thermoplastic materials are known in the art. For example, U.S. Pat. Nos. 3,755,527 and 3,959,421 relate to processes for producing melt-blown continuous mats or webs on drums. U.S. Pat. No. 3,313,665 relates to forming filaments into articles by a process which includes treating the filaments with gas under pressure and orienting the filaments in a transverse direction of the article and then bonding the filaments by application of hot vaporized liquid. U.S. Pat. No. 3,023,075 discloses a method and apparatus for shaping fibrous rods into a desired cross section. U.S. Pat. No. 3,110,642 relates to a method of producing a fibrous product from melt blown thermoplastic fibers by application of a stream of inert gas or stream propelled substantially at right angles to a melt or solution issuing from the supply container at a velocity and under a pressure sufficient to attenuate the melt or solution into the form of fibers. U.S. Pat. No. 3,595,245 relates to a tow of entangled continuous fibers of polypropylene formed by melt-blowing techniques.

SUMMARY OF THE INVENTION

In the present invention, thermoplastic materials are converted directly into thermally bonded, coherent fibrous products by melt blowing techniques. The fibrous product is in the form of a rod having a relatively dense, rigid skin in which the fiber portions are oriented primarily in a longitudinal direction with respect to the axis of the product, and a less dense core in which the fiber portions are oriented primarily in a transverse direction with respect to the axis of the product. Thus, the general orientation of fibers is randomly parabolic. The products are made by melt blowing fibers and intercepting them by a fiber collecting and forming device which permits a relatively heavy build-up of fiber mass in the central portion and a relatively light build-up of fibers in a lip portion surrounding the central portion. As fibers are continuously deposited on the collecting and forming device, the product thus formed is withdrawn at a rate synchronized with collection of fibers such that the aforesaid build-up is maintained, and such that the lip portion is folded back over the central portion by the collecting and forming device to form the rod as described.

DETAILED DESCRIPTION OF THE INVENTION

Basically, the method of formation involves extruding a molten thermoplastic material through a nozzle into a fine stream and attenuating the stream by a converging flow of high velocity gas (usually air), which breaks the stream into discontinuous fibers of small diameter. In general, the resulting fibers have an average diameter of less than about 10 microns with very few, if any, of the fibers exceeding 20 microns in diameter. Usually, the average diameter of the fibers is within the range of about 1–15 microns. The fibers are discontinuous, they generally have a length of about 10 mm.

Figure 1:
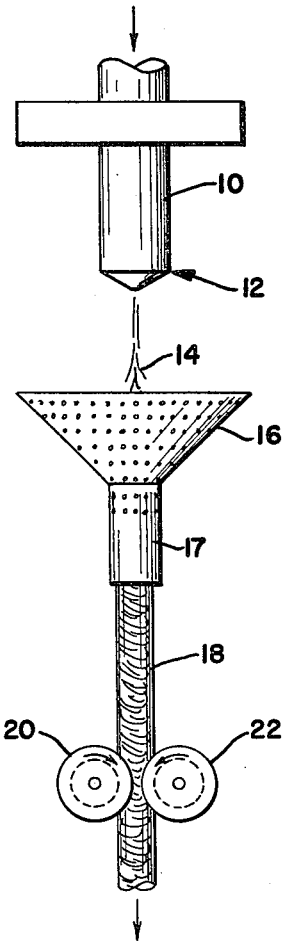
FIG. 1 is a schematic view of the overall process according to this invention.

Referring to the drawings, FIG. 1 is a schematic view of apparatus for carrying out the process of this invention. Molten thermoplastic material enters extruder 10 and is forced therethrough in the direction of the arrow. Material exists from nozzle 12 and is immediately contacted by gas at the nozzle tip being forced under pressure in the direction indicated by arrows. A plurality of nozzles suitably arranged may be used if desired. The gas may be heated, and serves to attenuate the extruded thermoplastic material into a plurality of fibers 14 and direct them to a combination collecting and forming device 16. The fibers form a mass at the throat 50 of the collecting and forming device, and once build-up of the fibrous mass occurs at this point, the leading portion thereof, which has now assumed the shape of a self-supporting rod 18 may be manually pulled from the exit end and fed into feed rolls 20 and 22. The speed of rolls 20 and 22 is synchronized with the rate of fiber extrusion such that the build-up of fiber mass on the collecting and forming device 16 is substantially continuous and of a predetermined magnitude as will be explained hereinafter in greater detail.

Figure 2:
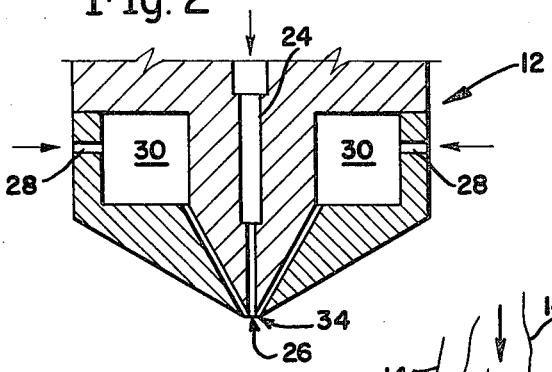
FIG. 2 is a detailed view in longitudinal cross section of an extrusion nozzle which may be used in the process.

FIG. 2 is a detail view in cross section showing a suitable nozzle 12 for simultaneously extruding thermoplastic material and directing air at the material as it is extruded into fibers. Such nozzles are well known in the art, but a brief, general description of a suitable nozzle follows. Nozzle 12 is fitted onto a suitable extrusion device (not shown) wherein molten thermoplastic material is forced under pressure in the direction of the arrow leading to the center chamber 24. Molten thermoplastic material is continuously forced through passage 24 and exits from opening 26. Pressurized gas (e.g., air) enters passages 28 into the circular manifold 30, through circular passage 32 and exits from the circular opening 34 where it is directed at an angle towards the extruded material. The gas so directed serves to attenuate the extruded material into a plurality of fibers 14 and direct them to the forming and collecting device 16.

Figure 3:
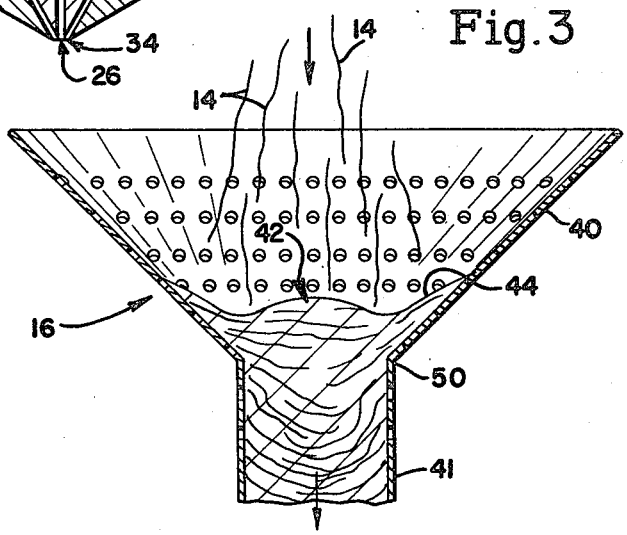
FIG. 3 is a detailed view in cross section of a fiber collecting and forming device, and the manner in which fibers are deposited thereon in accordance with this invention.

FIG. 3 illustrates one embodiment of the invention in which fibers 14 from nozzle 12 are deposited on collecting and forming device 16, which will herein sometimes be referred to as a collector. Fibers 14 will be deposited randomly on the collector generally as shown, with the largest mass formed in the center thereof. Due at least partially to the turbulence created by the air from nozzle 12, some fibers will also be deposited on the inclined wall 40 of collector 16. The fibers are in somewhat of a thermoplastic condition when they are deposited on the collector 16, such that they will adhere or thermally bond to each other.

According to the process of this invention, the fibers are deposited on collector 16 such that the accumulated mass will assume the general shape shown in FIG. 3, i.e., the greatest build up in the center 42, with the mass of fibers decreasing as the radius of the flared collector 14 increases, to thereby form a peripheral lip 44 of fibers around the collector 14. Once the mass of fibers builds up to this point, the fiber rod formed thereby is gradually withdrawn in the direction of the arrow (FIG. 1) at a speed such as to substantially maintain the shape shown in FIG. 3. As the rod 18 is withdrawn, lip 44 is continuously folded back over the central fiber build-up 42 to result in a relatively dense, rigid skin 46.

Rod 18 may be withdrawn by conventional means, such as by a pair of pull rolls 20 and 22. The rod may be started by temporarily blocking the exit of the collector until the rod begins to form and then withdrawing the rod by a hook and threading it through the pull rolls. It is important that the speed of withdrawal of the rod be synchronized with the rate of build up the fiber mass so as to maintain the build up on the inclined wall of collector 16. This may be accomplished either by adjusting the rate of fiber extrusion or by the speed of the pull rolls 20 and 22.

The collector may conveniently be funnel-shaped as illustrated, trumpet shaped, or the like. The collector is provided with a throat section 50 which offers resistance to the lip 44 of fiber mass, to fold lip 44 back over the central portion 42 as the rod is withdrawn. The collector is conveniently provided with openings 52 to allow the escape of gas from nozzle 12 without causing undue turbulence within the collector 16.

Figure 4:
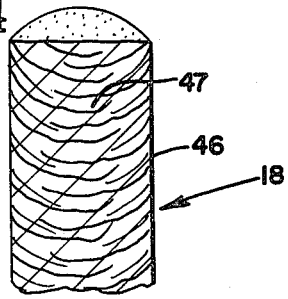
FIG. 4 is a detail view in longitudinal cross section of a fiber rod according to this invention.

FIG. 4 illustrates the rod-like fibrous product 18 formed by the process. As shown, the individual fibers assume a generally parabolic shape in the rod as the lip 44 is folded back over the central portion 42. The fibers in the lip portion 44, being deposited while still in a thermoplastic state, thermally bond together. As they are compressed while passing through throat 50, a relatively dense skin 46 having suitable porosity and integrity and uniform composition is formed around the inner fibers while generally maintaining their generally parabolic shape. The fibers are oriented such that portions in the skin are primarily longitudinally oriented while portion in the core are primarily transversely oriented. The fibrous product has adequate rigidity and resiliency for use in filters, ink pen reservoirs, etc.

Figure 6:
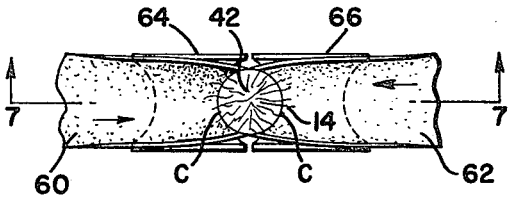
FIG. 6 is a plan view of the embodiment shown in FIG. 5.
Figure 5:
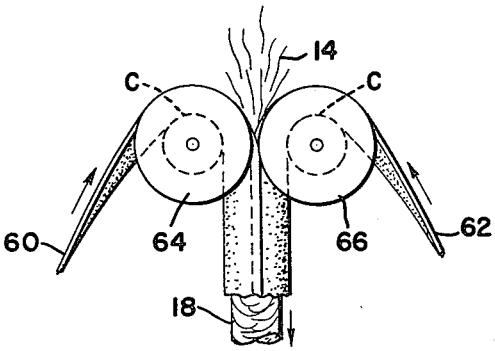
FIG. 5 is a schematic representation of apparatus for carrying out a different embodiment of the invention.
Figure 7:
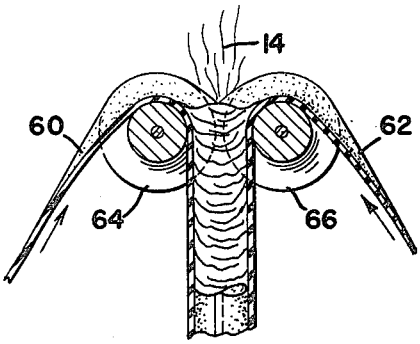
FIG. 7 is a representation of the collecting and forming device of the embodiment illustrated in FIGS. 5 and 6.

Other apparatus for carrying out the invention is illustrated in FIGS. 5, 6 and 7 wherein continuous belts 60 and 62 are used as the collector and take-away for the rod. As shown in the drawings, belts 60 and 62 travel over forming rolls 64 and 66 which are shaped such that in combination they form a cylindrical opening at their nip. Belts 60 and 62 follow the contour of the rolls and continuously form a collector and forming device in essentially the same manner as the rigid, stationary collector illustrated in FIG. 3. In this case, the take-away speed will be governed by the speed of the belts 60 and 62.

The means for collecting the fibers and forming the relatively heavy build up of fibrous mass in the throat section with decreasing mass as the radius of the flared section increases will vary in degree of flare over a wide range, so long as the aforesaid central fibrous mass and lip is developed. For example, the collector may be trumpet shaped wherein the flare is variable. In the use of continuous belts as described for FIGS. 5, 6 and 7, the flare is dependent upon the diameter of rolls 64 and 66 and the contour (illustrated at c) of the surface thereof. In the funnel design illustrated in FIG. 3, the wall 40 must be inclined with respect to the body 41 of the device, i.e., the angle between surface 40 and 41 is between 90° and 180°. Preferably this angle is no greater than about 170°. Most desirably, this angle is between about 110° and 150°. Those skilled in the art will be able to design other shapes, such as trumpet or rolls (as illustrated in FIGS. 5, 6 and 7) using this angular range as a guideline. For example, where a trumpet or pair of rolls is used, for a 7.9 mm diameter rod, the effective circular portion may have a radius of about 3.9 mm to about 4.00 mm, in which case rolls 64 and 66 would have an appropriate contour relative thereto.

In a typical example of suitable apparatus, a funnel shaped collector is designed to be a total of 95 mm in length, 7.9 mm, inside diameter, with the flared section occupying 10 mm of axial length. Angle between surface 40 and 41 is 124°. The collector is 38 mm in diameter at its open end, and is perforated with 1/16 inch openings, 64 openings per square inch. To form fibrous rods with such a collector according to this invention, the following operating parameters are found using 2.6 grams polymer per minute:

| Extrusion Speed, Meters/Min. | Fiber Diameter, Microns | Rate Rod Take-Away, Meters/Min. |
|---|---|---|
| 11,000 | 15 | 0.705 |
| 24,000 | 10 | 0.705 |
| 37,500 | 8 | 0.705 |

In operating the melt-blowing process to produce fibers having diameters between about 1–6 microns, smooth molten flow of the thermoplastic material and smooth attenuation of the fibers is required. This is achieved through the selection and control of the appropriate combination of nozzle tip temperature, thermoplastic material flow rate, and thermoplastic material molecular weight to give an apparent viscosity in the die holes of from about 10 to about 800 poise, preferably within the range of from about 50 to about 300 poise. For a particular material, by measuring the pressure upstream of the nozzle holes and by measuring the flow rate, the apparent viscosity is calculated from the geometry of the nozzle by methods well known in polymer technology. The viscosity can usually be adjusted into the operable range by varying the nozzle tip temperature.

Herein, polyester resin is used to illustrate the present invention. Other thermoplastic resins suitable for such use include other polyolefins, e.g. polyethylene; polyamides, e.g., poly(hezamethylene adipamide), poly(α-caproamide) and poly(hexamethylene sebacamide); polyvinyls such as polystyrene; and other polymers such as polytrifluorochloroethylene.

To be melt blown into fibers, polyethylene terephthalate, it has been found, must be thermally treated at temperatures in excess of 280° C., up to about 330° C. and preferably, within the range of from about 300° to about 315° C. The degree of thermal treatment necessary varies with the melt index of the particular material employed and with the rates used in the melt blowing process. The thermal treatment may be carried out in the extruder alone or partially in the extruder and partially in the nozzle.

The flow rate, the rate at which the material is forced through the opening in the nozzle, is dependent upon the specific design of the nozzle and extruder. However, suitable flow rates are from about 0.07 to about 0.5 or more gm./min./opening. The polymer flow rate may be controlled by the speed of the extruder. The gas flow rates are also limited by the design of the nozzle. Suitable products are obtained at air rates from about 0.8 to about 10 lbs./hr.

The fiber diameters of the nonwoven mats of this invention are achieved by adjusting the gas flow rates for a given molten material flow rate so that one obtains a pounds of gas/pounds of material ratio of from about 5 to about 50, preferably, between about 9 and about 12. Air rates of this magnitude serve to attenuate the molten material extruded through the die openings into fibers having suitable diameters. When the air rates for a given molten material flow rate are too low, large coarse fibers are formed. Then, as air flow rates are too high relative to the rate of polymer flow, the fibers break without being attenuated and have large diameters.

An important factor in producing the products of this invention is the distance separating the collecting device from the openings in the nozzle. It is normally necessary to space the collecting device or collector at least about 50 mm from the nozzle openings to obtain the desired pattern of fiber mass deposit on the collector. Advantageously, the nozzle-collector-distance is no greater than about 150 mm, and preferably, from about 85 to about 110 mm.

The fibrous rod produced by the process according to this invention is illustrated in FIG. 4. Passing the rod through the throat 50 of the forming and collecting device compresses the lip portion 44 into a relatively dense skin 46, the fibers of which are thermally bonded such as to cause the rod to be relatively rigid. As the lip is continuously folded back upon take-away of the rod, the fibers form a randomly parabolic pattern, such that fiber parts in the central or core portion 47 are generally perpendicular to the axis while the fiber parts in the skin 46 are more or less parallel to the axis. It will be obvious that all of the fibers do not, of themselves, form such a parabolic shape. As the mass contains randomly deposited fibers, some of the individual fibers may not extend entirely across the rod—some fibers may even lie mostly in the skin of the rod. The general pattern, however, is parabolic due to the compression and drag forces on the lip 44 as the rod is formed. The skin is relatively thick, dense, and porous and may occupy about 5–50% (normally 15–35%) of the cross section, while the core is much less dense.

Upon formation of rod 18, it may be conveyed to further processing equipment, such as a cutter for forming individual rods of predetermined lengths as is well known in the art.

The fibrous rod may subsequently be converted into filters such as cigarette smoke filters or other gas or liquid filters. The fibrous rod may also be used as an ink reservoir for marking pens, wicks, etc.

Unless otherwise specified, inherent viscosity is measured with a 0.5 weight % solution of polymer in a mixture of 60/40 phenol/tetrachloroethane.

The following examples are submitted for a better understanding of the invention.

EXAMPLE 1

Poly(ethylene terephthalate) polymer having an inherent viscosity of 0.35 is extruded in a ¾-inch diameter screw extruder at a melt temperature of 285° C. to feed a melt-blowing spinneret comprised of a tube mounted concentrically in a cylindrical air passageway having a conical taper ending at the level of a single 0.3 mm diameter orifice in the tube. As the melt is extruded from the orifice, a stream of heated air (304° C.) attenuates the melt to form melt-blown fibers. Polymer is extruded at a rate of 0.2 pound per hour into air flowing at a rate of 2.0 standard cubic feet per minute (SCFM) to produce 1 to 10 micron diameter fibers which are collected in a funnel type collector, tube the throat of which is located 85 mm below the orifice level. The fibers are pulled through the funnel into a tube having an inside diameter equal to the desired outside diameter of the cigarette filter to form a rod of thermally-bonded fibers. Filters cut from this rod have a relatively thick, dense, but porous, outside wall with a less dense core of thermally-bonded fiber layers orientated perpendicular to the longitudinal axis of the filter. Based on photographs of longitudinal cross-section of the filters, the wall comprises 40–50% of the available area. Twenty-millimeter filter tips cut from the rods made according to this method, weighing 83 mg, remove 51% of total particulate matter (TPM) at a pressure drop of 3.9 to 4.3 inches of water at a volumetric flow rate of 17.5 ml/second.

EXAMPLE 2

Using the method described in Example 1, poly(ethylene terephthalate) polymer having inherent viscosity of 0.35 is extruded at a melt temperature of 290° C. at a rate of 0.2 pound per hour into 322° C. air flowing at 2.5 SCFM to make 1 to 10 micron diameter fibers which are collected in a funnel type collector, the throat of which is located 84 mm below the orifice. These fibrous bundles are pulled through the forming tube with a take-up device which pulls the newly-formed rod at a linear rate of 380 mm per minute. Filters cut from this rod have relatively dense, but porous, walls comprising 20–30% of the longitudinal cross-sectional area with a less dense core of thermally-bonded fiber layers orientated perpendicular to the longitudinal axis of the filter comprising the remaining area. Twenty-millimeter tips cut from this rod, weighing 69 mg, remove 32% TPM at a pressure drop of 1.4 to 1.6 inches of water.

EXAMPLE 3

Filter rods are made according to the method described in Example 2 except the walls of the forming tube are heated to 85° C. Filters cut from this rod have relatively dense, but porous, walls comprising 15–20% of the longitudinal cross-sectional area with less dense layers of thermally-bonded fibers orientated perpendicular to the longitudinal axis of the filter in the remaining area. Twenty-millimeter tips cut from this rod, weighing 73 mg, remove 42% TPM at a pressure drop of 1.4 to 1.8 inches of water.

EXAMPLE 4

Using the method described in Example 1, poly(ethylene terephthalate) polymer having inherent viscosity of 0.35 is extruded at a melt temperature of 290° C. at a rate of 0.2 pound per hour into 314° C. air flowing at a rate of 2.0 SCFM to make 1 to 10 micron diameter fibers which are collected in a funnel type collector, the throat of which is located 91 mm below the orifice. Rods are removed from the forming tube at a linear rate of 412 mm per minute. Filters cut from these rods have relatively dense, but porous, walls comprising 30–40% of the longitudinal cross-sectional area with a less dense core of thermally-bonded filter layers in which the fibers are orientated perpendicular to the longitudinal axis of the filter. Twenty-millimeter tips cut from this rod, weighing 85 mg, remove 37% TPM at a pressure drop of 2.3 to 2.5 inches of water.

EXAMPLE 5

Using the method described in Example 1, poly(ethylene terephthalate) polymer having inherent viscosity of 0.35 is extruded at a melt temperature of 309° C. at a rate of 0.2 pound per hour into 311° C. air flowing at a rate of 2.0 SCFM to make 1 to 10 micron diameter fibers which were collected in a funnel type collector, which is cooled with chilled water to 28° C., the throat of which is located 105 mm below the orifice. Rods are removed from the forming tube at a linear rate of 705 mm per minute. Filters cut from these rods have relatively dense, but porous, walls comprising 20–30% of the longitudinal cross-sectional areas with a less dense core of thermally-bonded fiber layers in which the fibers were oriented perpendicular to the longitudinal axis of the filter. Twenty-millimeter tips cut from this rod, weighing 80 mg, remove 51% TPM at a pressure drop of 3.1 to 3.2 inches of water.

EXAMPLE 6

Using the method described in Example 5, poly(ethylene terephthalate) polymer having inherent viscosity of 0.35 is extruded at a melt temperature of 287° C. at a rate of 0.5 pound per hour into 292° C. air flowing at a rate of 3.0 SCFM to make 1 to 10 micron diameter fibers which are collected in a funnel type collector, the throat of which is located 90 mm below the orifice. The funnel section of this collector is perforated with ⅛-inch diameter holes which allow the air to flow from the sides of the funnel. Rods are removed from the forming tube at a linear rate of 1740 mm per minute. Filters cut from these rods have relatively thin, porous walls comprising 5–15% of the longitudinal cross-sectional area with a less dense core of thermally-bonded fiber layers in which the fibers are orientated perpendicular to the longitudinal axis of the filter.

EXAMPLE 7

Using the method described in Example 5, poly(propylene terephthalate) polymer having inherent viscosity of 0.35 is extruded at a melt temperature of 290° C. at a rate of 0.4 pound per hour into 355° C. air flowing at a rate of 1.6 SCFM to make 1 to 10 micron diameter fibers which are collected in a funnel type collector, the throat of which is located about 95 mm from the orifice. These fibers are pulled through the forming tube manually to form a filter rod. Filters cut from these rods comprise layers of thermally-bonded fibers in the core and dense walls.

EXAMPLE 8

Using the method described in Example 5, polypropylene polymer having inherent viscosity of 0.75 (measured with a ½ weight % solution of polymer in distilled tetraline with BHT stabilizer heated to 125° C.) is extruded at a melt temperature of 340° C. at a rate of 0.2 pound per hour into 355° C. air flowing at a rate of 2.0 SCFM to make 1 to 10 micron diameter fibers which are collected in a funnel type collector, the throat of which is located from about 95 mm from the orifice. These fibers are pulled through the forming tube to form a filter rod. Relatively soft, uniform filter rods which expand to a diameter approximately 25% larger than the tube inside diameter upon being pulled from the forming area are obtained by this method. The rods are compressed to the diameter of a cigarette and wrapped with paper. Tips of 20 mm are attached to cigarettes and efficiency determined by standard techniques. At a rod weight of 53 mg/20 mm tip and pressure drops of 1.7 inches of water, 45% of the tar is removed from the cigarette smoke.

EXAMPLE 9

Using the method described in Example 1, poly(ethylene terephthalate) polymer having inherent viscosity of 0.35 is extruded at a melt temperature of 300° C. at a rate of 0.2 pound per hour into 320° C. air flowing at a rate of 2.0 SCFM to make 1 to 10 micron diameter fibers which are collected in a funnel type collector, the throat of which having two, approximately 2 mm protrusions located on the tube wall. As the fibers are pulled through the tube, a filter rod having molded indentations is formed. Filters of this type are used to make vented cigarette filters which allow 20% dilution of the smoke with air.

EXAMPLE 10

Example 1 is repeated except a blend of 80% poly(ethylene terephthalate) (I.V.=0.35) and 20% poly(propylene terephthalate) (I.V.=0.37) is used in the melt-blown process to produce firm filter rods. The conditions for the melt-blown spinning are similar to those established for poly(ethylene terephthalte) alone.

EXAMPLE 11

Example 1 is repeated and firm filter rods were prepared. The rods are cut into 100-mm lengths and immediately conveyed to a heated molding device. At temperatures of 85° C., molded filters with radial flow characteristics are produced. The filtration efficiency of these filters is superior to conventional molded filters which require molding temperatures of 125° C.

EXAMPLE 12

Using the method described in Example 1, cellulose acetate polymer containing 39.8% acetyl having a textile viscosity of six seconds which is plasticized with 40 weight % triacetin is extruded at a melt temperature of 235° C. and rate of 0.2 pound per hour into a stream of 306° C. air flowing at a rate of 2.5 SCFM. One to 10 micron diameter fibers are collected in a funnel type collector, the throat of which is located 130 mm below the spinneret orifice. Firm filter rods are collected by manually pulling the fibers through the rod formation area. Twenty-millimeter tips tested on cigarettes are equal in filtration efficiency of cigarette smoke to commercial filters at the same pressure drops but are 20% lighter.

EXAMPLE 13

The process described in Example 1 is used to produce a filter element useful for the filtration of oil, water, and air. Poly(ethylene terephthalate) is converted to melt-blown fibers. The melt-blown fibers are directed into a perforated metal mold four inches in diameter having a solid core three inches in diameter. Melt-blown fibers are directed at the mold to give a thermally-bonded element five inches in height. This radial-flow element is then positioned in a solid canister and placed in oil, water or air steam. Small particles of dust and metal are effectively filtered from the fluid.

EXAMPLE 14

The process described in Example 1 is used to produce a cylindrical rod. The rod is cut to a length of 3.5 inches and inserted in an empty marking pen. An ink containing xylenes, ketones, and ethyl alcohol is added to the reservoir. The poly(ethylene terephthalate) fibers are not adversely affected by the solvent. The pen is used for several weeks. The reservoir has an increased capacity for ink because the fine fiber size result in excellent capillary action.

EXAMPLE 15

Example 13 is repeated except polypropylene is the thermoplastic polymer used in the preparation of the melt-blown articles.

The invention has been described in detail with particular reference to preferred embodiments thereof, but it will be understood that variations and modifications can be effected within the spirit and scope of the invention.

We claim:

1. Process of forming a fibrous mass comprising the steps of (1) extruding an attenuating molten thermoplastic material into a plurality of fibers by directing a jet of gas at the extruded material, said jet being directed such as to move the fibers toward a collecting and forming device having a radially flared end portion which converges into a throat section, (2) intercepting said fibers by said collecting and forming device to obtain a relatively heavy build-up of fibrous mass in the throat section, the mass decreasing as the radius of the flared upper section increases, (3) withdrawing the fibrous mass from said throat at a speed synchronized with the build-up of fibers on said collecting and forming device such that the outer fibers on said flared section are continuously folded back over the core of said fibrous mass to form a relatively dense skin and providing a generally randomly parabolic orientation of fibers in longitudinal cross-section.

2. Process according to claim 1 wherein said thermoplastic material is a polymer.

3. Process according to claim 2 wherein said thermoplastic material is a polyester.

4. Process according to claim 1 wherein said fibrous mass is an elongated shape.

5. Process according to claim 1 wherein said jet of gas is air and is directed at said extruded material substantially immediately as it emerges from the extrusion nozzle.

6. Process according to claim 1 wherein said collecting and forming device is funnel-shaped.

7. Process according to claim 1 wherein said collecting and forming device is trumpet-shaped.

8. Process according to claim 1 wherein said collecting and forming device comprises a pair of cooperating belts which are guided to form said collecting and forming device.

9. Process according to claim 1 wherein said collecting and forming device is perforated.

10. Process according to claim 1 wherein said collecting and forming device is located between about 50 and about 150 mm from the throat of said collecting and forming device.

11. Process according to claim 1 wherein said fibers are in a thermally bondable condition when deposited on said collecting and forming device.

* * * * *